US008015832B2

(12) United States Patent
Setoguchi et al.

(10) Patent No.: US 8,015,832 B2
(45) Date of Patent: Sep. 13, 2011

(54) REFRIGERANT FLOW DIVIDER OF HEAT EXCHANGER FOR REFRIGERATING APPARATUS

(75) Inventors: Takayuki Setoguchi, Sakai (JP); Makoto Kojima, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 608 days.

(21) Appl. No.: 12/087,659

(22) PCT Filed: Mar. 7, 2007

(86) PCT No.: PCT/JP2007/054474

§ 371 (c)(1),
(2), (4) Date: Jul. 11, 2008

(87) PCT Pub. No.: WO2007/102556

PCT Pub. Date: Sep. 13, 2007

(65) Prior Publication Data

US 2009/0013715 A1 Jan. 15, 2009

(30) Foreign Application Priority Data

Mar. 8, 2006 (JP) ..... 2006-062480

(51) Int. Cl.
*F25D 17/06* (2006.01)

(52) U.S. Cl. ..... 62/93; 62/525; 62/272

(58) Field of Classification Search ..... 62/524, 62/525, 90, 93, 272, 150, 324.5; 251/129.01; 165/215, 228, 231, DIG. 197
See application file for complete search history.

(56) References Cited

U.S. PATENT DOCUMENTS 5,400,607 A * 3/1995 Cayce ..... 62/90
5,404,938 A * 4/1995 Dinh ..... 165/113
5,448,897 A * 9/1995 Dinh ..... 62/333
5,533,669 A * 7/1996 Kokawa et al. ..... 237/1 SL
5,845,702 A * 12/1998 Dinh ..... 165/104.21
6,269,650 B1 * 8/2001 Shaw ..... 62/176.6
6,644,049 B2 * 11/2003 Alford ..... 62/173
6,694,756 B1 * 2/2004 Taras et al. ..... 62/173
7,770,405 B1 * 8/2010 Dillon ..... 62/176.5
2006/0218949 A1 * 10/2006 Ellis et al. ..... 62/173
2008/0098756 A1 * 5/2008 Uselton ..... 62/173

FOREIGN PATENT DOCUMENTS

JP 5-118682 A 5/1993
JP 2000-179968 A 6/2000
JP 2005-273923 A 10/2005
JP 2005-315309 A 11/2005
KR 0161075 1/1999

OTHER PUBLICATIONS

Translation of JP 2005-273923 to Takaku et al.*

* cited by examiner

*Primary Examiner* — Mohammad Ali

(74) *Attorney, Agent, or Firm* — Birch, Stewart, Kolasch & Birch, LLP.

(57) ABSTRACT

A refrigerant flow dividing apparatus of a heat exchanger for refrigerating apparatus is provided with a minimal number of refrigerant flow regulating valves and suppresses increase in the size and costs of the apparatus. Refrigerant is supplied to paths of the heat exchanger for refrigerating apparatus including a heat exchanger for reheat dehumidification via a refrigerant flow divider provided with paths. Each path of the refrigerant flow divider is provided with a refrigerant flow regulating valve, and a predetermined one of the refrigerant flow regulating valves of the paths also functions as a reheat dehumidification valve.

6 Claims, 7 Drawing Sheets

REFRIGERANT FLOW DIVIDER OF HEAT EXCHANGER FOR REFRIGERATING APPARATUS

TECHNICAL FIELD

The present invention relates to a refrigerating apparatus, and particularly to a refrigerant flow dividing apparatus that appropriately divides refrigerant to paths of a heat exchanger for refrigerating apparatus in an air conditioner provided with a heat exchanger for reheat dehumidification operation.

BACKGROUND ART

FIG. 5 shows, as an example of a refrigerating apparatus, an indoor unit 21 of a typical wall-mounted air conditioner provided with a cross flow fan 29. In FIG. 5, the air conditioner 21 includes a casing main body 20. First and second air intake grills 23, 24 are formed in the upper surface and the upper portion of the front surface of the casing main body 20. An air outlet 25 is provided at the lower corner of the front surface of the casing main body 20.

Also, a flow duct 27, which extend from the air intake grills 23, 24 toward the air outlet 25, is provided in the casing main body 20. An indoor heat exchanger 26 having a lambdoid cross-section facing the first and second air intake grills 23, 24 is provided at the upstream section of the flow duct 27. A cross flow fan 29, a tongue 22, and a scroll portion 30 are sequentially installed adjacent to each other at the downstream section of the flow duct 27. The tongue 22 and the scroll portion 30 form a vortex fan housing, which has opening portions 30*a*, 22*a*. A vane wheel (fan rotor) 29*a* of the cross flow fan 29 is located in the opening portions 30*a*, 22*a* to rotate in the direction of the arrow (clockwise in FIG. 5).

The tongue 22 is arranged in the vicinity of the second air intake grill 24 along the outer diameter of the vane wheel (fan rotor) 29*a* of the cross flow fan 29, and has a predetermined height. The lower portion of the tongue 22 is connected to an air-flow guiding portion 22*b*, which also serves as a drain pan below the indoor heat exchanger 26. The downstream side of the air-flow guiding portion 22*b* and a downstream portion 30*b* of the scroll portion 30 form an air outlet path 28, which has a diffuser structure as shown in the drawing and extends toward the air outlet 25, such that the airflow blown out of the vane wheel 29*a* of the cross flow fan 29 is efficiently blown out from the air outlet 25.

An air direction changing plate 31 is provided in the air outlet path 28 between the scroll portion 30 and the air-flow guiding portion 22*b* of the tongue 22.

The tongue 22 is formed as shown in the drawing. As shown by the arrows in chain lines, the flow of air from the indoor heat exchanger 26 through the vane wheel 29 of the cross flow fan 29 to the air outlet 25 proceeds through the vane wheel 29*a* in a direction perpendicular to the rotary shaft of the vane wheel 29*a* and blown out from the vane wheel 29*a* while curving along the rotation direction as a whole, and is subsequently bent along the air outlet path 28 and blown out from the air outlet 25.

The wind speed distribution during low load operation in the indoor heat exchanger 26 for an air conditioner configured as described above was analyzed, dividing the indoor heat exchanger 26 into a section A, a section B, a section C, and a section D as shown in FIG. 5. The wind speed at the section D, which directly faces the second air intake grill 24, is the highest. The wind speed at the section C, which faces the first air intake grill 23 in an inclined state, is slightly reduced as compared to the section D. Also, at the section B, which is covered with the upper portion of the casing main body 20 and into which air does not directly flow, the wind speed is further reduced as compared to the section C. Furthermore, at the section A where air is blocked by the tongue 22, the wind speed is further reduced as compared to the section B.

The above-mentioned indoor heat exchanger 26 of the air conditioner provided with multiple paths generally has a flow divider 3 including flow dividing paths $P_1$, $P_2$ as shown in FIG. 6 in order to divide refrigerant that flows into the main body of the indoor heat exchanger 26 to the paths of the main body of the indoor heat exchanger 26. The flow divider 3 determines the refrigerant distribution ratio of the flow dividing paths $P_1$, $P_2$ in accordance with the rated operation. A refrigerant supply pipe 4 is provided at the inlet of the flow divider 3.

Therefore, during the rated operation, the refrigerant temperatures at the outlets of the paths of the indoor heat exchanger 26 are approximately equal (expressed by the thickness of the arrows in FIG. 6). However, during low load operation in which the refrigerant amount is reduced, that is, during partial load operation, the following problem arises due to the influence of the wind speed distribution of the indoor heat exchanger 26 that differs in accordance with the position in the flow duct as described above. That is, as shown in the graph of FIG. 7, since there is a margin in the heat exchange capacity at path $P_1$, 8A of a part WF where the wind speed is high, the refrigerant temperature is high at the outlet of the paths. In contrast, as for refrigerant at paths $P_2$, 8B of a part WS where the wind speed is low, since there is no margin in the heat exchange capacity, the refrigerant temperature at the outlet becomes lower than the refrigerant temperature at the outlet of the paths where the wind speed is high (see $\Delta T$ in FIG. 7). In the graph of FIG. 7, the paths $P_1$, 8A of the part WF where the wind speed is high are shown in white, and the paths $P_2$, 8B of the part WS where the wind speed is low is shown with dots.

As a method for solving such a problem, conventionally, the above-mentioned paths are each provided with a refrigerant flow regulating valve. The refrigerant temperature at the outlets of the paths are equalized by adjusting the refrigerant flow rate of the paths in accordance with the temperature detected by temperature detectors provided at the outlets of the paths (for example, refer to patent document 1).

[Patent Document 1] Japanese Laid-Open Patent Publication No. 5-118682

DISCLOSURE OF THE INVENTION

Problems that the Invention is to Solve

However, in the case of the conventional refrigerant flow dividing apparatus, since the paths are provided with the refrigerant flow regulating valves, which are configured by expensive and large electric expansion valves, the size and costs of the apparatus are inevitably increased.

In particular, as the heat exchanger 1 for refrigerating apparatus, an apparatus as shown in FIG. 8 has been proposed that carries out dehumidification operation to reduce humidity of indoor air by restricting the ability of the compressor or restricting the airflow rate of the fan during a cooling cycle so as to improve comfort during cooling operation. The operation modes during dehumidification operation include a normal "dehumidification operation" in which indoor air is cooled and dehumidified, and then blown into a room as it is, and a "reheat dehumidification operation" in which after the indoor air is cooled and dehumidified, the indoor air is reheated to approximately an intake temperature and blown into the room. In the heat exchanger 1, which executes two operation modes, a heat exchanger 11 for evaporator includes a heat exchanger 12 for dehumidification on the front surface, that is, upstream of airflow, and a heat exchanger 13 for reheat dehumidification at the back, that is, downstream of the airflow.

As shown in FIG. 8, first to fourth paths $P_1$ to $P_4$ of the refrigerant flow divider 3 are connected to the evaporator heat exchanger 11, the dehumidification heat exchanger 12, and the reheat dehumidification heat exchanger 13. Refrigerant from the refrigerant supply pipe 4 is supplied to the heat exchangers.

In the case of the heat exchanger 1 of FIG. 8, the flow rate of airflow differs among upper portions 11*a*, 12*a*, center portions 11*b*, 12*b*, and lower portions 11*c*, 12*c* of the evaporator heat exchanger 11 and the dehumidification heat exchanger 12. Thus, the heat exchange capacity differs among the upper, center, and lower portions, which causes the temperature of the refrigerant at the outlets of the paths $P_1$ to $P_4$ to vary.

In this case, in addition to the refrigerant flow regulating valves $V_1$ to $V_4$ of the paths $P_1$ to $P_4$, reheat dehumidification valves $V_5$, $V_6$ for the reheat dehumidification heat exchanger 13 are further required. Thus, the total of six refrigerant flow regulating valves are required.

Accordingly, it is an objective of the present invention to provide a refrigerant flow dividing apparatus of a heat exchanger for refrigerating apparatus that suppresses increase in the size and costs of the apparatus by using, as a reheat dehumidification valve, a predetermined one or more of refrigerant flow regulating valves of paths.

Means for Solving the Problems

To achieve the above objective, a first aspect of the present invention provides a refrigerant flow dividing apparatus of a heat exchanger for refrigerating apparatus. The refrigerant flow dividing apparatus supplies refrigerant to a plurality of paths of the heat exchanger for refrigerating apparatus including a heat exchanger for reheat dehumidification via a refrigerant flow divider provided with a plurality of paths. A predetermined one of a plurality of refrigerant flow regulating valves also functions as a reheat dehumidification valve.

In this case, among a number of refrigerant flow regulating valves, which adjust the flow rate of refrigerant in the paths, a refrigerant flow regulating valve of a predetermined path is used also as a reheat dehumidification valve. This eliminates the need for a conventional dedicated reheat dehumidification valve. Thus, the number of the refrigerant flow regulating valves is reduced.

A second aspect of the present invention provides a refrigerant flow divider of a heat exchanger for refrigerating apparatus. The refrigerant flow divider supplies refrigerant to a plurality of paths of the heat exchanger for refrigerating apparatus including a heat exchanger for reheat dehumidification via a refrigerant flow divider provided with a plurality of paths. Among the paths of the refrigerant flow divider, only the path in which an uneven flow is produced is provided with a refrigerant flow regulating valve separately from a reheat dehumidification valve.

In this case, the refrigerant flow regulating valves for adjusting the flow rate of refrigerant in the paths are provided only at parts of an uneven flow except for the reheat dehumidification valve. Thus, the number of the refrigerant flow regulating valves is reduced.

The refrigerant flow regulating valve is preferably configured by a variable valve opening type electromagnetic flow control valve. In this case, the conventional refrigerant flow regulating valve provided with a variable valve opening structure is used as a minimal refrigerant flow regulating valve. Thus, the size and costs of the refrigerant flow dividing apparatus is reduced as compared to the conventional apparatus.

The refrigerant flow regulating valve is preferably a direct-acting electromagnetic on-off valve. In this case, instead of the conventional refrigerant flow regulating valves having expensive and highly accurate variable valve opening structure, direct-acting electromagnetic valves having inexpensive and simple structure are used as the refrigerant flow regulating valves. Thus, the size and costs of the refrigerant flow dividing apparatus is further reduced.

BRIEF DESCRIPTION OF THE DRAWINGS

FIG. 3(*b*) is a diagram showing an OFF state of the refrigerant flow regulating valve;

BEST MODE FOR CARRYING OUT THE INVENTION

First Embodiment

Figure 1:
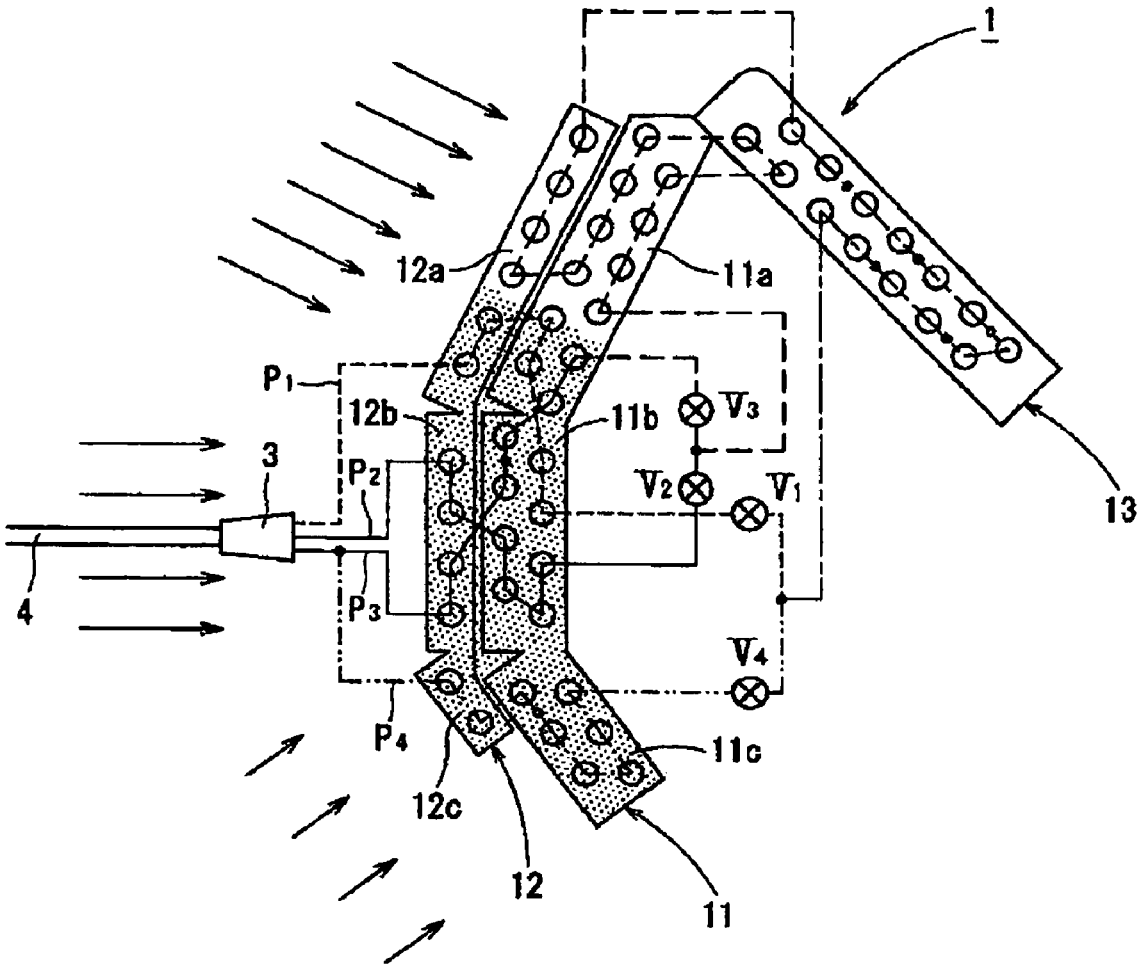
FIG. 1 is a diagram illustrating the structure of a refrigerant flow dividing apparatus of a heat exchanger for refrigerating apparatus according to a first embodiment of the present invention.

FIG. 1 shows the structure of a refrigerant flow dividing apparatus of a heat exchanger for refrigerating apparatus according to a first embodiment of the present invention.

The refrigerating apparatus of the first embodiment carries out dehumidification operation to reduce humidity of indoor air by restricting the ability of the compressor or the airflow rate of the fan during a cooling cycle in order to, for example, improve comfort during cooling operation. The operation modes during dehumidification operation include two modes, which are a normal dehumidification operation, in which indoor air is cooled and dehumidified, and then blown into a room as it is, and a reheat dehumidification operation, in which after indoor air is cooled and dehumidified, the indoor air is reheated approximately to an intake temperature, and then blown into the room. The air conditioner of the first embodiment executes the two dehumidification operation modes.

A heat exchanger 1 shown in FIG. 1 includes a heat exchanger 12 for dehumidification on the front side (upstream of airflow) and a heat exchanger 11 for evaporator on the rear side (downstream of airflow). A heat exchanger 13 for reheat dehumidification is provided at the upper portion of the evaporator heat exchanger 11. First to fourth paths $P_1$ to $P_4$ of a refrigerant flow divider 3 are connected to the evaporator heat exchanger 11, the dehumidification heat exchanger 12, and the reheat dehumidification heat exchanger 13. A predetermined amount of refrigerant is supplied to the heat exchangers 11, 12, 13 in accordance with the operating condition of the air conditioner from a refrigerant supply pipe 4 of a refrigeration circuit of an air conditioner.

In the case of the heat exchanger 1 configured as described above, the flow rate of airflow differs among upper portions 11*a*, 12*a*, center portions 11*b*, 12*b*, and lower portions 11*c*, 12*c* of the evaporator heat exchanger 11 and the dehumidification heat exchanger 12. Due to the resulting difference in the heat exchange capacity, the refrigerant temperature differs among the outlets of the paths $P_1$ to $P_4$.

Therefore, as described above, in the conventional structure, the paths $P_1$ to $P_4$ are provided with refrigerant flow regulating valves $V_1$ to $V_4$. In this case, however, in addition to the refrigerant flow regulating valves $V_1$ to $V_4$, reheat dehumidification valves $V_5$, $V_6$ for the reheat dehumidification heat exchanger 13 are provided, which sums up to six valves. Thus, the total number of refrigerant flow regulating valves is increased.

Therefore, in the structure of the first embodiment, at least two of the first to fourth refrigerant flow regulating valves $V_1$ to $V_4$ (refrigerant flow regulating valves $V_3$, $V_4$) are commonly used as the reheat dehumidification valves to eliminate the need for the conventionally used dedicated reheat dehumidification valves $V_5$, $V_6$.

With this configuration, the total number of the refrigerant flow regulating valves is only four, which includes the refrigerant flow regulating valves $V_1$ to $V_4$ for uneven flow prevention. Thus, the number of the refrigerant flow regulating valves is efficiently reduced. As a result, size and costs of the entire refrigerant flow dividing apparatus are efficiently reduced.

Second Embodiment

Figure 2:
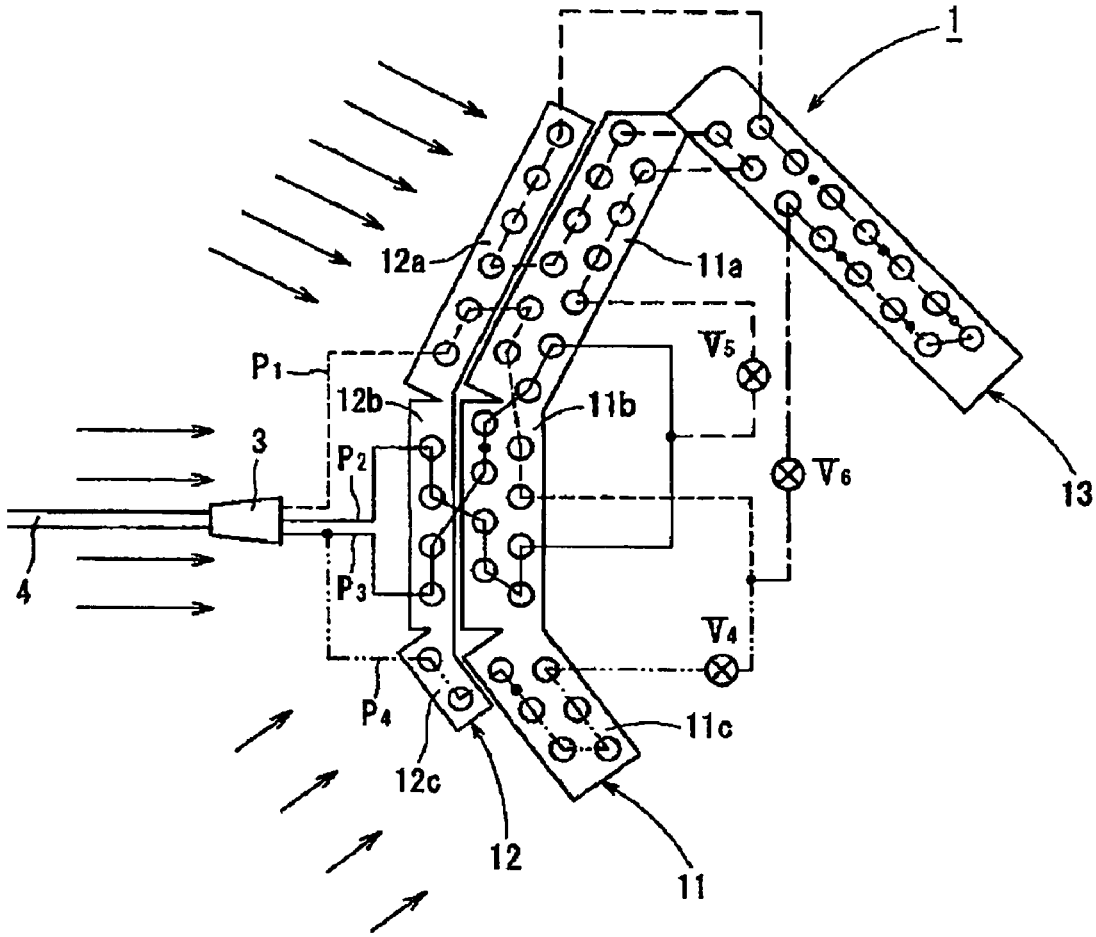
FIG. 2 is a diagram illustrating the structure of a refrigerant flow dividing apparatus of a heat exchanger for refrigerating apparatus according to a second embodiment of the present invention.

FIG. 2 shows a refrigerant flow dividing apparatus of a heat exchanger for refrigerating apparatus according to a second embodiment of the present invention.

Like the above-mentioned first embodiment, the second embodiment also employs an air conditioner that executes two dehumidification operations including the normal dehumidification operation and the reheat dehumidification operation. The structure of the evaporator heat exchanger 11, the dehumidification heat exchanger 12, and the reheat dehumidification heat exchanger 13 are the same as the first embodiment.

In this case, as shown by the arrows in FIG. 2, the airflow is extremely reduced at the lower portions 11*c*, 12*c* of the evaporator heat exchanger 11 and the dehumidification heat exchanger 12. Since there will be no margin for the heat exchange capacity, the outlet temperature of the refrigerant that flows through the lower portions 11*c*, 12*c* is undesirably reduced. In contrast, relatively sufficient airflow is secured at the upper portions 11*a*, 12*a* and the center portions 11*b*, 12*b* of the evaporator heat exchanger 11 and the dehumidification heat exchanger 12. Thus, above-mentioned problem does not occur.

Therefore, in the second embodiment, unlike the first embodiment, in which the refrigerant flow regulating valves are provided in the paths $P_1$ to $P_4$, the refrigerant flow regulating valve is only provided in the fourth path $P_4$ (see $V_4$ in FIG. 2), which corresponds to the lower portions 11*c*, 12*c*, in which an uneven flow is produced, and other refrigerant flow regulating valves only function as the reheat dehumidification valves (see $V_5$, $V_6$ in FIG. 2).

With this configuration, the number of the total refrigerant flow regulating valves is only three including one refrigerant flow regulating valve $V_4$ for uneven flow prevention and two reheat dehumidification valves $V_5$, $V_6$. Thus, the number of the refrigerant flow regulating valves is further reduced. As a result, the size and costs of the refrigerant flow dividing apparatus are further reduced.

Third Embodiment

Figure 3A:
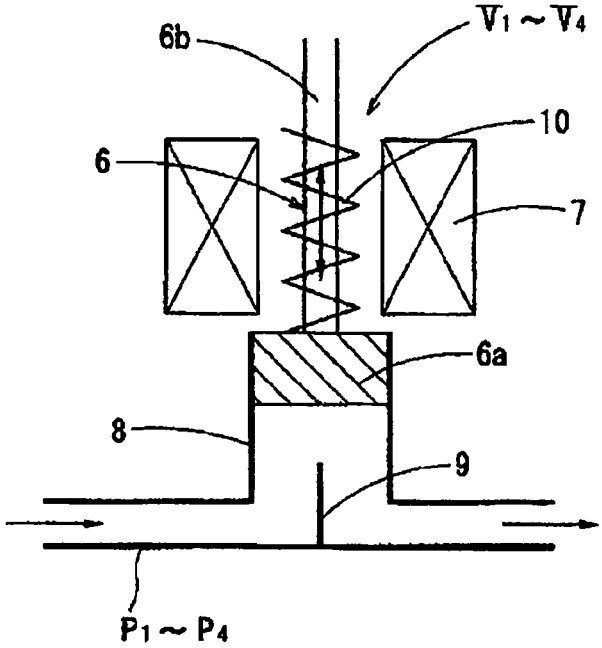
FIG. 3(*a*) is a diagram showing an ON state of a refrigerant flow regulating valve used in a refrigerant flow dividing apparatus of a heat exchanger for refrigerating apparatus according to a third embodiment of the present invention.
Figure 3B:
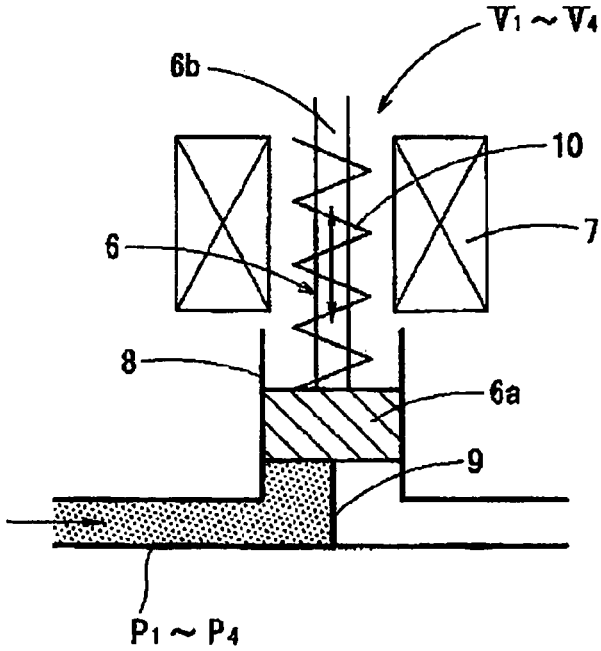
Figure 4:
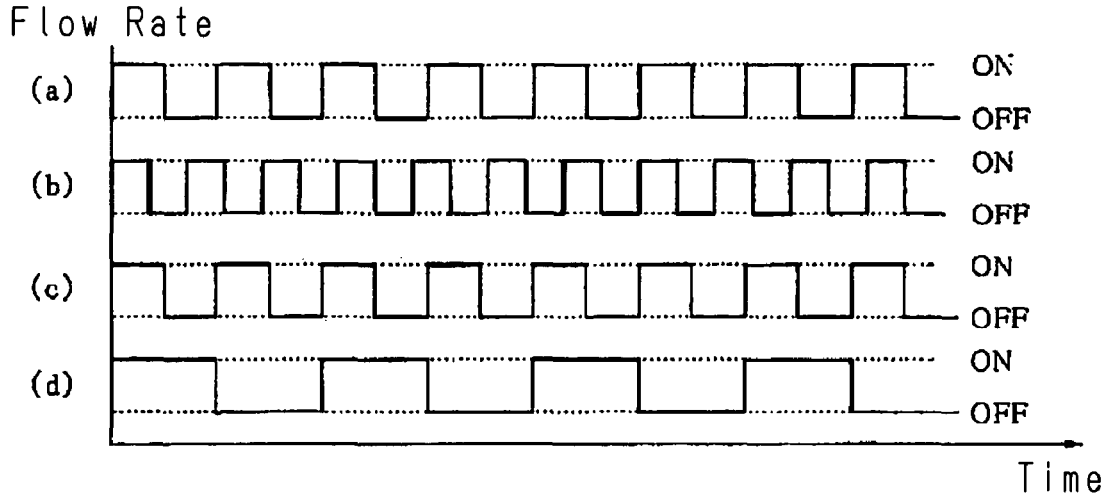
FIG. 4 is a diagram showing control signals of the refrigerant flow dividing apparatus of the heat exchanger for refrigerating apparatus according to the third embodiment of the present invention.
Figure 5:
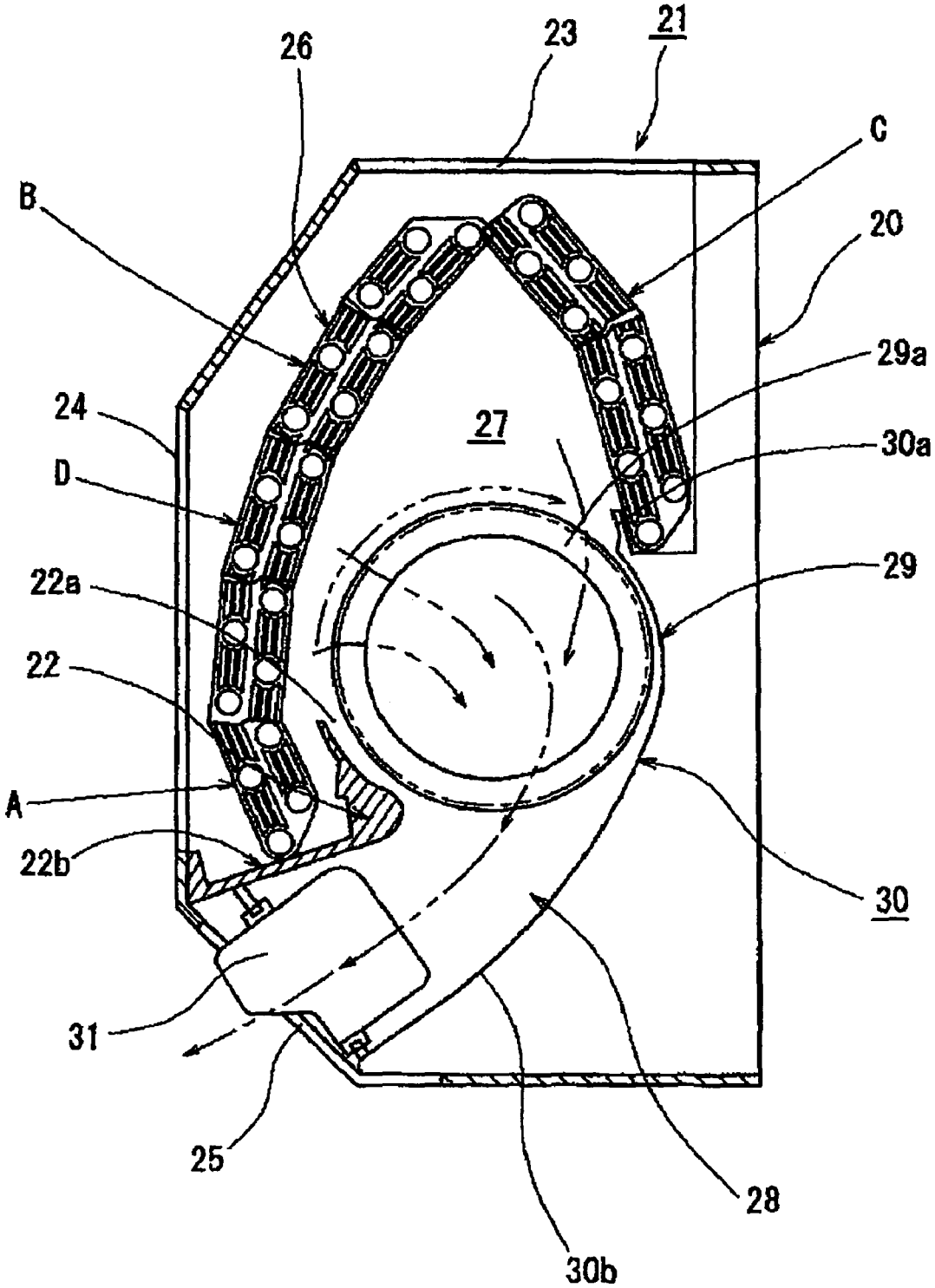
FIG. 5 is a diagram illustrating the structure of an indoor unit of a conventional air conditioner.
Figure 6:
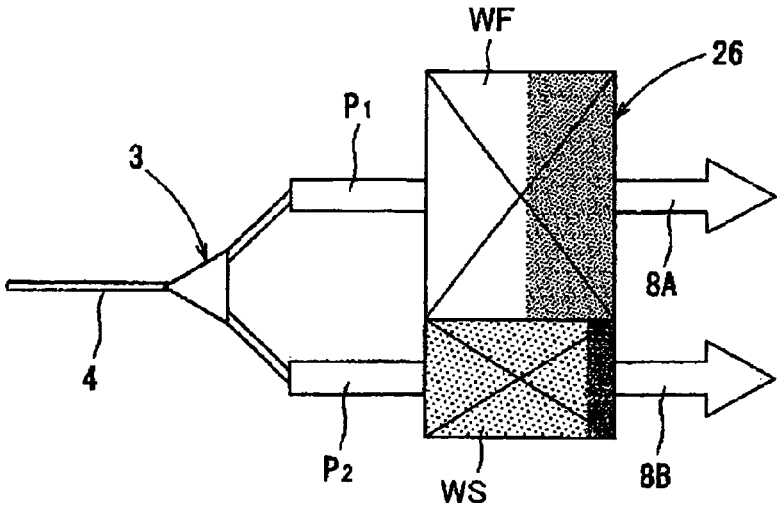
FIG. 6 is a diagram illustrating a heat exchanger with multiple paths for the indoor unit of the conventional air conditioner, and the structure and operation of a flow divider corresponding to the heat exchanger.
Figure 7:
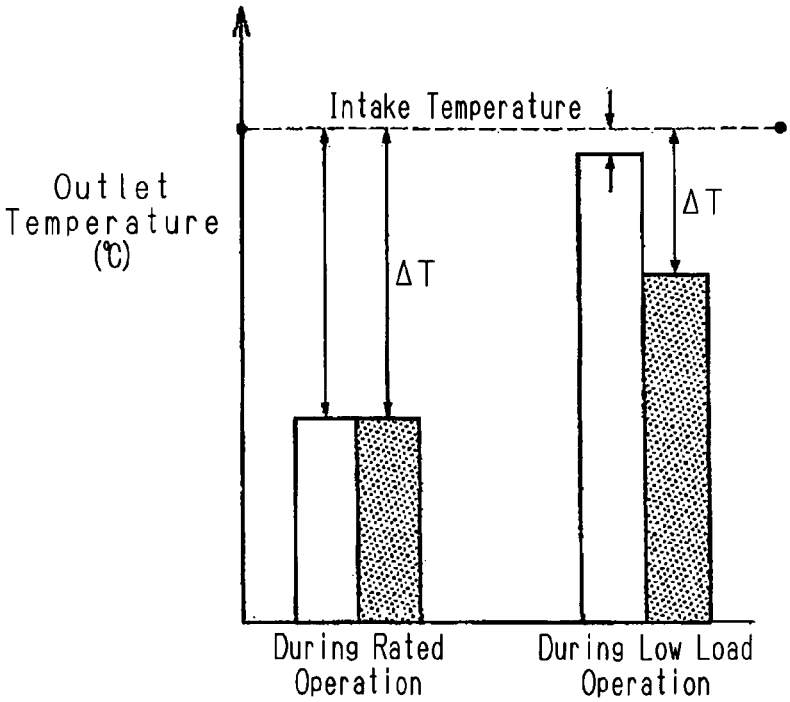
FIG. 7 is a diagram that compares the outlet temperature during a rated operation and during a low load operation of the indoor heat exchanger obtained by the flow divider of FIG. 6 of the conventional air conditioner.
Figure 8:
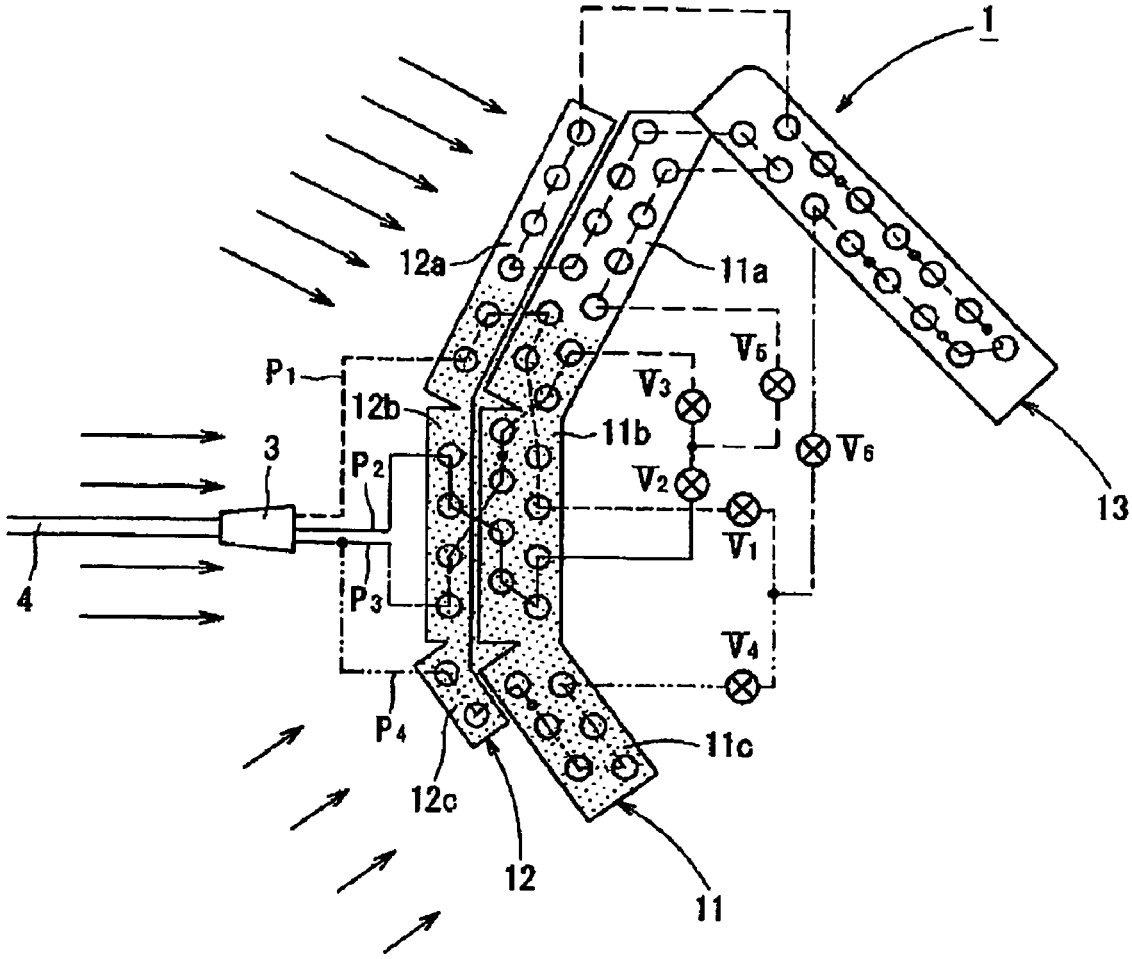
FIG. 8 is a diagram illustrating the structure of a heat exchanger for air conditioner that executes a normal dehumidification operation and a reheat dehumidification operation, and the structure of a refrigerant flow dividing apparatus of the heat exchanger.

FIGS. 3 and 4 show the structure and control signals of refrigerant flow regulating valves used in a refrigerant flow dividing apparatus of a heat exchanger for refrigerating apparatus according to a third embodiment.

In the first and second embodiments, electromagnetic flow regulating valves (electric expansion valves) that are electrically adjustable are used as the refrigerant flow regulating valves $V_1$ to $V_4$ and the reheat dehumidification valves $V_5$, $V_6$. In contrast, in the third embodiment, the refrigerant flow regulating valves $V_1$ to $V_4$ and the reheat dehumidification valves $V_5$, $V_6$ are each configured by a valve shown in FIGS. 3(*a*) and 3(*b*). The valve shown in FIGS. 3(*a*) and 3(*b*) are provided with an electromagnetic plunger 6, which includes a plunger head (valve body) 6*a* and a plunger rod 6*b*, a solenoid coil 7, which lifts the plunger rod 6*b* of the electromagnetic plunger 6, and a valve closing spring 10, which urges the plunger rod 6*b* of the electromagnetic plunger 6 downward.

The valve of the third embodiment has a structure in which the plunger head 6*a* of the electromagnetic plunger 6 corresponds to a valve seat wall 9 in a sleeve-like pilot port 8 of each of the paths $P_1$ to $P_4$. Therefore, the basic structure of the valve is the same as a simple direct-acting electromagnetic on-off valve, which selectively closes and opens a path. However, the refrigerant flow rate of the valves of the third embodiment per unit time is appropriately adjusted in accordance with the load state (uneven flow state) of the paths $P_1$ to $P_4$ by controlling an ON state (energized state: see FIG. 3(*a*)) and an OFF state (de-energized state: see FIG. 3(*b*)) of the direct-acting electromagnetic valves using different duty ratios such as control signals shown in FIGS. 4(*a*) to 4(*d*).

With this configuration, instead of the conventional electromagnetic flow regulating valves (electric expansion valves) having expensive and highly accurate variable valve opening structure, the direct-acting electromagnetic valves having inexpensive and simple structure are used as the refrigerant flow regulating valves. Thus, the size of the refrigerant flow dividing apparatus is further reduced.

The invention claimed is:

1. A refrigerant flow dividing apparatus of a heat exchanger for refrigerating apparatus, which refrigerant flow dividing apparatus supplies refrigerant to a plurality of paths of the heat exchanger for refrigerating apparatus including a heat exchanger for reheat dehumidification via a refrigerant flow divider provided with a plurality of paths, the refrigerant flow dividing apparatus comprising:

a heat exchanger for dehumidification provided on an upstream of airflow, a heat exchanger for evaporator provided on a downstream of airflow, and a heat exchanger for reheat dehumidification further provided at an upper portion of the evaporator heat exchanger, wherein the plurality of paths include first to fourth paths, the first to fourth paths of the refrigerant flow divider are connected to the evaporator heat exchanger, the dehumidification heat exchanger and the reheat dehumidification heat exchanger, and wherein the first to fourth paths are provided with first to fourth refrigerant flow regulating valves, and at least two of the first to fourth refrigerant flow regulating valves are commonly used as reheat dehumidification valves.

2. The refrigerant flow dividing apparatus of a heat exchanger for refrigerating apparatus according to claim 1, wherein the refrigerant flow regulating valves are variable valve opening type electromagnetic flow control valves.

3. The refrigerant flow dividing apparatus of a heat exchanger for refrigerating apparatus according to claim 1, wherein the refrigerant flow regulating valve is a direct-acing electromagnetic on-off valve.

4. A refrigerant flow dividing apparatus of a heat exchanger for refrigerating apparatus, which refrigerant flow dividing apparatus supplies refrigerant to a plurality of paths of the heat exchanger for refrigerating apparatus including a heat exchanger for reheat dehumidification via a refrigerant flow divider provided with a plurality of paths, the refrigerant flow dividing apparatus comprising:

a heat exchanger for dehumidification provided on an upstream of airflow, a heat exchanger for evaporator provided on a downstream of airflow, and a heat exchanger for reheat dehumidification further provided at an upper portion of the evaporator heat exchanger, wherein the plurality of paths include first to fourth paths, the first to fourth paths of the refrigerant flow divider are connected to the evaporator heat exchanger, the dehumidification heat exchanger and the reheat dehumidification heat exchanger, and wherein among the paths of the refrigerant flow divider, only a path in which an uneven flow is produced is provided with a refrigerant flow regulating valve separately from a reheat dehumidification valve.

5. The refrigerant flow dividing apparatus of a heat exchanger for refrigerating apparatus according to claim 4, wherein the refrigerant flow regulating valves are variable valve opening type electromagnetic flow control valves.

6. The refrigerant flow dividing apparatus of a heat exchanger for refrigerating apparatus according to claim 4, wherein the refrigerant flow regulating valve is a direct-acing electromagnetic on-off valve.

* * * * *